US012729515B2

(12) United States Patent
Houjou

(10) Patent No.: US 12,729,515 B2
(45) Date of Patent: Sep. 8, 2026

(54) CONSTRUCTION MACHINE

(71) Applicant: KOMATSU LTD., Tokyo (JP)

(72) Inventor: Atsushi Houjou, Tokyo (JP)

(73) Assignee: KOMATSU LTD., Tokyo (JP)

( * ) Notice: Subject to any disclaimer, the term of this patent is extended or adjusted under 35 U.S.C. 154(b) by 334 days.

(21) Appl. No.: 18/681,138

(22) PCT Filed: Jun. 24, 2022

(86) PCT No.: PCT/JP2022/025374
§ 371 (c)(1),
(2) Date: Feb. 5, 2024

(87) PCT Pub. No.: WO2023/021845
PCT Pub. Date: Feb. 23, 2023

(65) Prior Publication Data

US 2024/0279911 A1 Aug. 22, 2024

(30) Foreign Application Priority Data

Aug. 20, 2021 (JP) ..... 2021-134840

(51) Int. Cl.
*E02F 9/26* (2006.01)
*E02F 9/08* (2006.01)

(52) U.S. Cl.
CPC ..... *E02F 9/264* (2013.01); *E02F 9/0883* (2013.01)

(58) Field of Classification Search
CPC ..... E02F 9/264; E02F 9/0883
See application file for complete search history.

(56) References Cited

U.S. PATENT DOCUMENTS

| | | | | |
|---|---|---|---|---|
| 4,437,162 | A | 3/1984 | Kato | |
| 4,773,260 | A * | 9/1988 | Ohno | F02M 37/0094 73/114.54 |
| 6,282,953 | B1 | 9/2001 | Benjey | |
| 7,940,165 | B1 * | 5/2011 | Oxley | B60K 15/03006 340/450 |
| 9,528,872 | B2 * | 12/2016 | Stevenson | G08B 19/02 |
| 2015/0268083 | A1 | 9/2015 | Ogiwara et al. | |

FOREIGN PATENT DOCUMENTS

| | | | |
|---|---|---|---|
| CN | 210315413 | U | 4/2020 |
| CN | 112729472 | A | 4/2021 |
| JP | 56-151922 | U | 11/1981 |
| JP | 58-33126 | A | 2/1983 |

(Continued)

OTHER PUBLICATIONS

Request for the submission of an Opinion received for Korean Application No. 10-2023-7043283, mailed on Dec. 9, 2025, 5 Pages.

(Continued)

*Primary Examiner* — Valentin Neacsu
*Assistant Examiner* — Michael R Stabley
(74) *Attorney, Agent, or Firm* — Spencer Fane LLP

(57) ABSTRACT

A construction machine includes a vehicle body, a tank disposed in the vehicle body, and a sensor including a detection portion configured to detect the liquid. The tank accommodates a liquid. The sensor is supported by the tank. The tank includes a reduced width section formed to reduce a width of a predetermined range including the detection portion.

16 Claims, 9 Drawing Sheets

(56) References Cited

FOREIGN PATENT DOCUMENTS

| | | | |
|---|---|---|---|
| JP | 2-42171 | A | 2/1990 |
| JP | 2002-013962 | A | 1/2002 |
| JP | 2002339902 | A | 11/2002 |
| JP | 2003-341799 | A | 12/2003 |
| JP | 2008-221913 | A | 9/2008 |
| JP | 2008-268104 | A | 11/2008 |
| JP | 2009-110714 | A | 5/2009 |
| JP | 2012-163508 | A | 8/2012 |
| JP | 2015-182558 | A | 10/2015 |
| JP | 2017-090127 | A | 5/2017 |
| JP | 2020-007051 | A | 1/2020 |

OTHER PUBLICATIONS

The Office Action for the corresponding Japanese application No. 2021-134840, issued on Aug. 22, 2023.
First Office Action received for Chinese Application No. 202280042481.5, mailed on Nov. 29, 2025, 8 pages.
The International Search Report for the corresponding international application No. PCT/JP2022/025374, issued on Sep. 20, 2022.
The Office Action for the corresponding Japanese application No. 2021-134840, issued on Jan. 9, 2024.

* cited by examiner

CONSTRUCTION MACHINE

CROSS-REFERENCE TO RELATED APPLICATIONS

This application is a U.S. National stage application of International Application No. PCT/JP2022/025374, filed on Jun. 24, 2022. This U.S. National stage application claims priority under 35 U.S.C. § 119(a) to Japanese Patent Application No. 2021-134840, filed in Japan on Aug. 20, 2021, the entire contents of which are hereby incorporated herein by reference.

BACKGROUND

Technical Field

The present invention relates to a construction machine.

Background Art

A construction machine is provided with a plurality of tanks that store water or hydraulic fluid. For example, the construction machine described in Japanese Patent Laid-open No. 2020-7051 comprises a drain water tank that stores moisture recovered by means of a dehumidifying function of an air-conditioner provided to the cab, and a water level sensor disposed in the drain water tank.

In addition, the construction machine is also provided with an expansion tank that stores cooling water for the engine and the radiator. It is necessary to ensure predetermined amounts of water and air inside the expansion tank, and the predetermined amount or more of water in the tank is ensured by means of a water level sensor.

SUMMARY

However, while it is necessary for the tank to have enough width to ensure the predetermined amount or more of water, when the width is great, the changes in the water level vary greatly when the vehicle is inclined. As a result, the water level sensor may become exposed from the liquid surface when the vehicle is inclined and a false detection that the liquid amount is insufficient may occur even through the amount of water is the predetermined amount or greater.

An object of the present disclosure is to provide a construction machine with which it is possible to limit false detections of liquid shortages.

A construction machine according to a first embodiment of the present disclosure comprises a vehicle body, a tank, and a sensor. The tank is disposed in the vehicle body and accommodates a liquid. The sensor includes a detection portion that detects the liquid and is supported by the tank. The tank includes a reduced-width section. The reduced-width section is formed to reduce the width of a predetermined range width including the detection portion.

According to an embodiment of the present disclosure, there is provided a construction machine with which it is possible to limit false detections of liquid shortages.

DETAILED DESCRIPTION OF EMBODIMENT(S)

A hydraulic excavator will be described as an example of a construction machine according to the present disclosure with reference to the following drawings.

(Configuration)

(Outline of Hydraulic Excavator 1)

Figure 1:
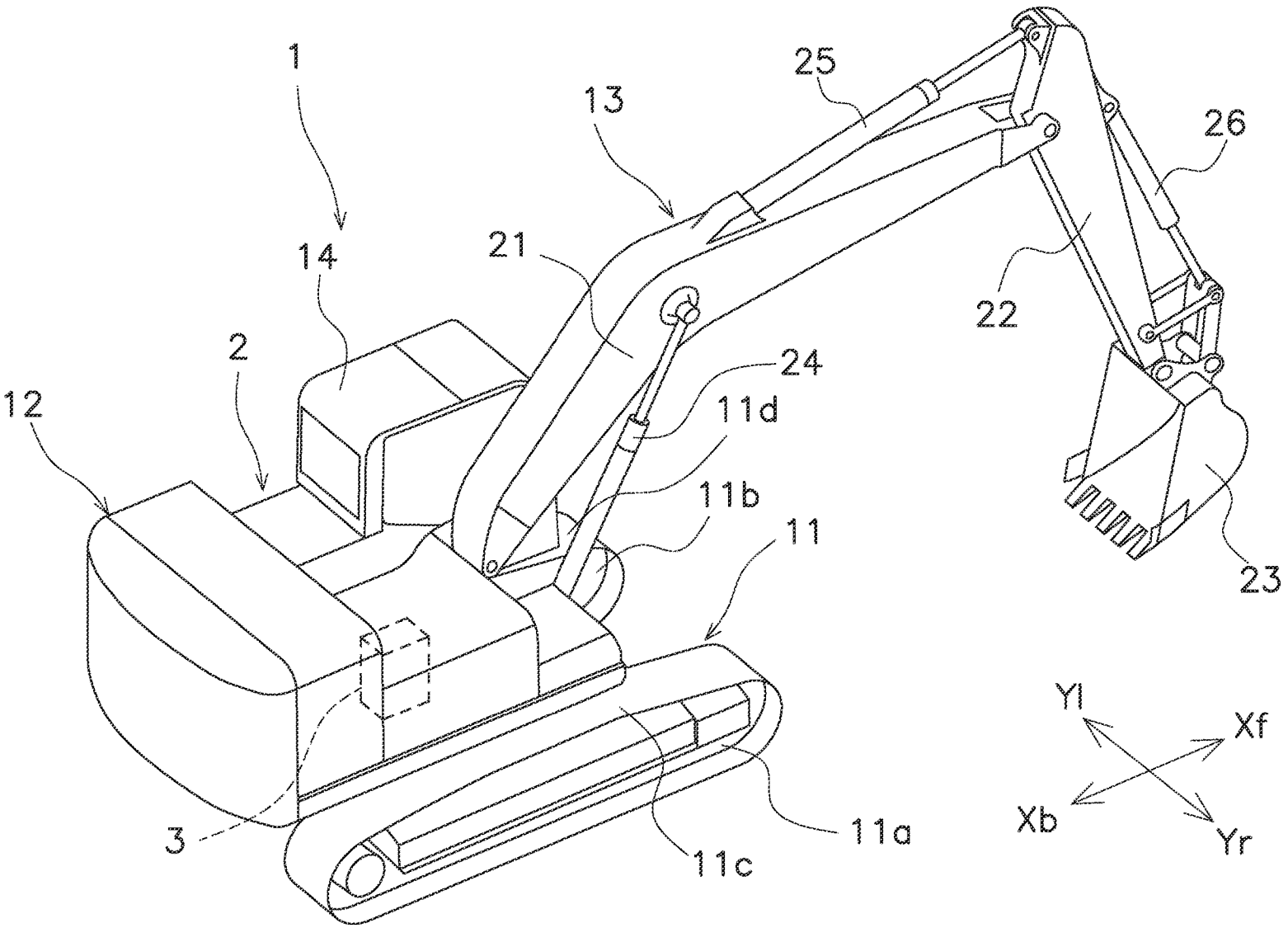
FIG. 1 is a perspective view of a hydraulic excavator according to an embodiment of the present disclosure.

FIG. 1 is a schematic view of a configuration of a hydraulic excavator 1 of the present embodiment.

The hydraulic excavator 1 (example of a construction machine) comprises a vehicle body 2, a tank unit 3, and a control section 4 (see below mentioned FIG. 8).

The vehicle body 2 has a traveling unit 11, a revolving unit 12, and a work implement 13 as illustrated in FIG. 1. The traveling unit 11 includes a pair of travel devices 11*a* and 11*b*. The travel devices 11*a* and 11*b* respectively include crawler belts 11*c* and 11*d*. A travel motor rotates due to driving power from an engine to drive the crawler belts 11*c* and 11*d* whereby the hydraulic excavator 1 travels.

The revolving unit 12 is mounted on the traveling unit 11. The revolving unit 12 is configured to be able to turn with respect to the traveling unit 11 about an axis in the up-down direction by means of an unillustrated turning device.

A cab 14 that serves as an operator's seat in which an operator sits while driving, is disposed in a front left side position of the revolving unit 12. The operator's seat, a lever for operating the work implement 13, and a monitor 71 (see FIG. 8), etc., are disposed inside the cab 14.

The revolving unit 12 accommodates, on the rear side, the tank unit 3 as well as an unillustrated engine and hydraulic pump. In the present embodiment, front and rear and left and right are explained using the driver's seat in the cab 14 as reference. The direction when the operator's seat faces forward is the forward direction (see arrow Xf) and the direction opposite the forward direction is the rearward direction (see arrow Xb). The right side and left side in the lateral direction when the operator's seat faces forward are respectively the right direction (see arrow Yr) and the left direction (see arrow Yl). The "height direction," the "vertical direction," and the "horizontal direction" in the present description indicate, unless specifically stated otherwise, directions while the vehicle body 2 is in a horizontal state without being inclined.

The work implement 13 includes a boom 21, an arm 22, and an excavating bucket 23 and is attached in a front center position of the revolving unit 12 as illustrated in FIG. 1. The work implement 13 is disposed on the right side of the cab 14. The base end of the boom 21 is coupled to the revolving unit 12 in a rotatable manner. The tip end of the boom 21 is coupled to the base end of the arm 22 in a rotatable manner. The tip end of the arm 22 is coupled to the excavating bucket 23 in a rotatable manner. The excavating bucket 23 is attached to the arm 22 so that the opening thereof faces in the direction (rearward) of the revolving unit 12. The hydraulic excavator 1 including the excavating bucket 23 attached in this manner is also referred to as a backhoe.

Hydraulic cylinders 24-26 (boom cylinder 24, arm cylinder 25, and bucket cylinder 26) are disposed so as to respectively correspond to the boom 21, the arm 22, and the excavating bucket 23. The work implement 13 is driven due to the driving of the cylinders 244-26. As a result, work such as excavation can be carried out.

(Tank Unit 3)

Figure 2:
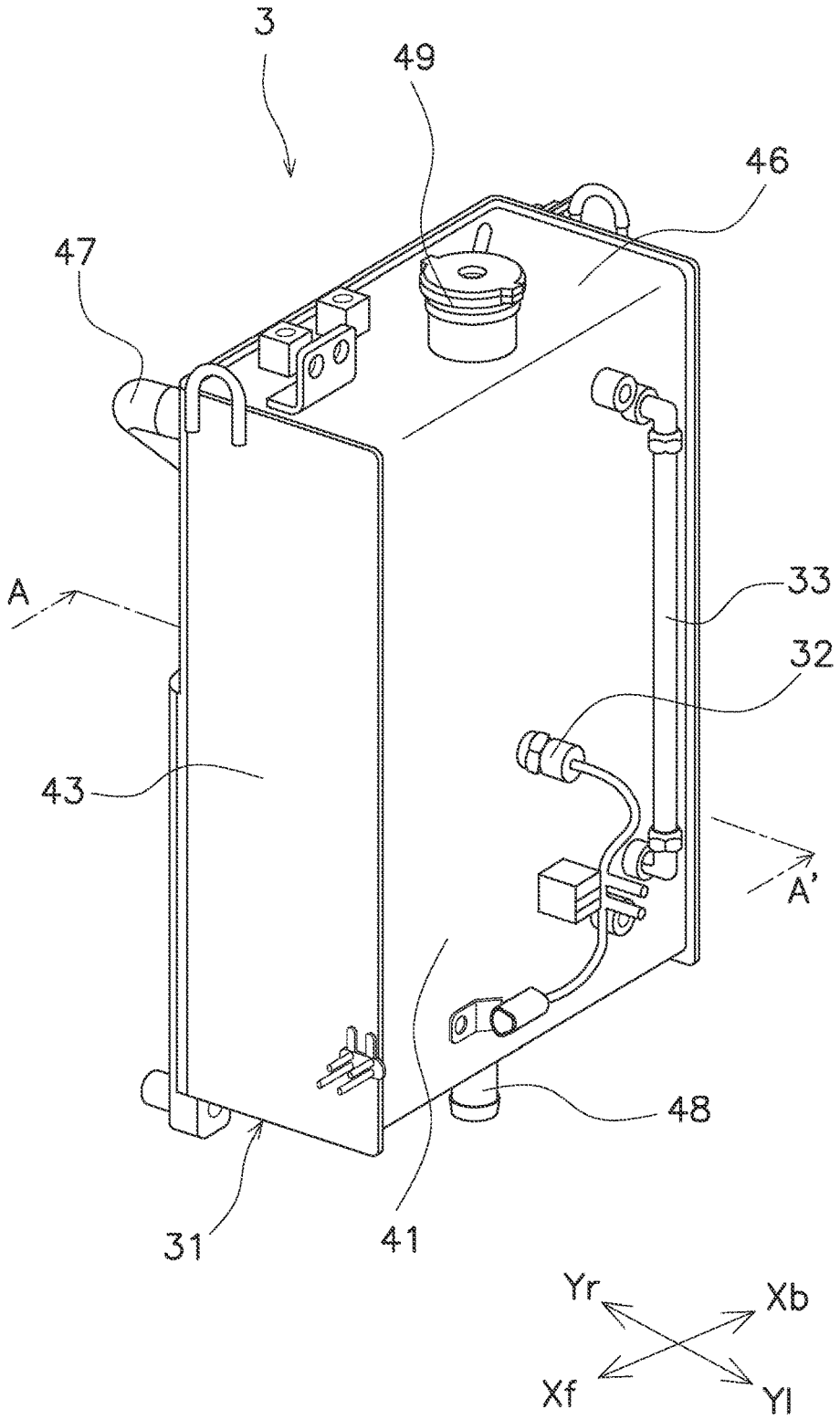
FIG. 2 is an external view of an expansion tank according to the embodiment of the present disclosure.
Figure 3:
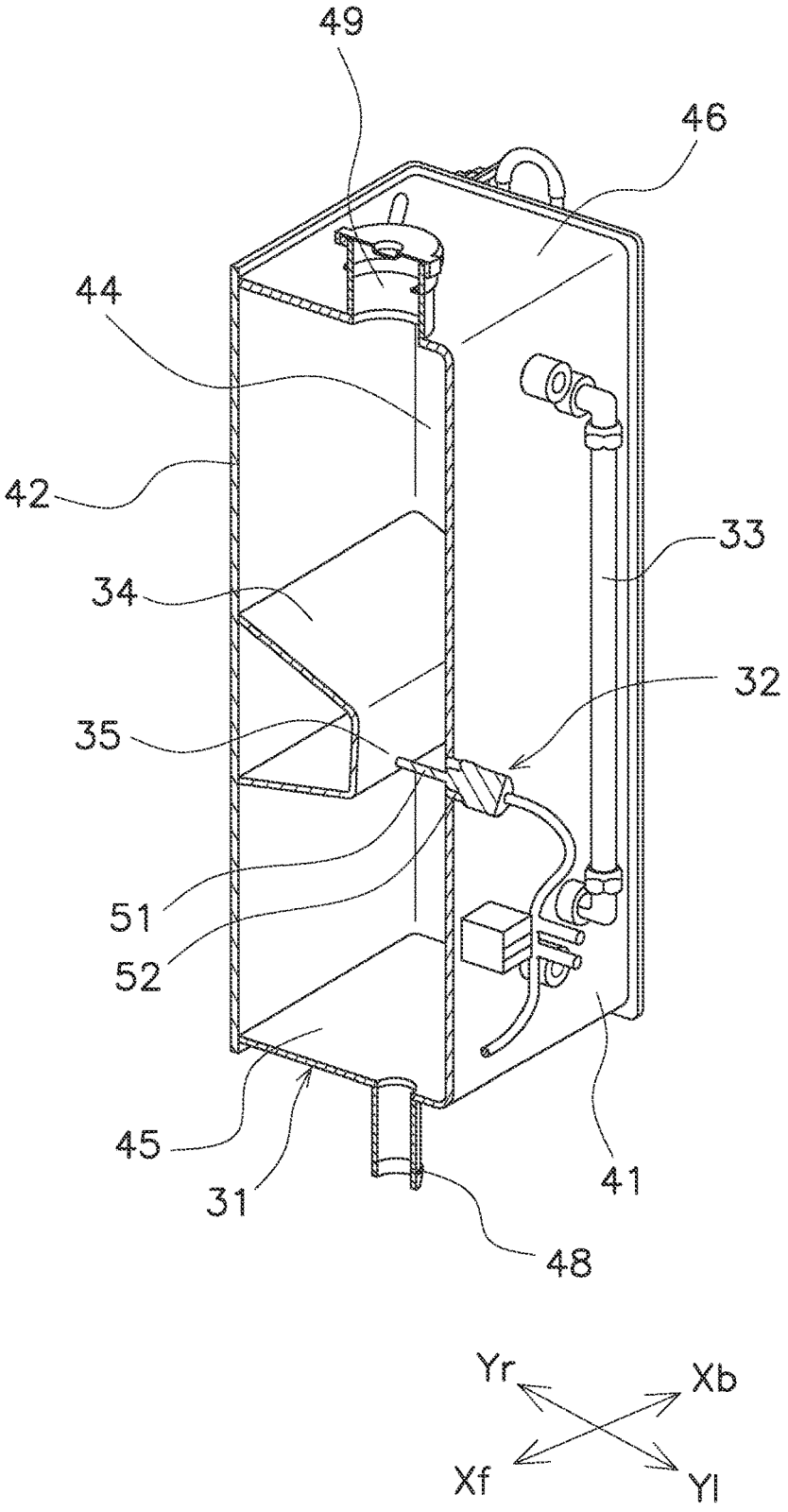
FIG. 3 is a perspective view of a cross-section along line A-A' in FIG. 2.
Figure 4:
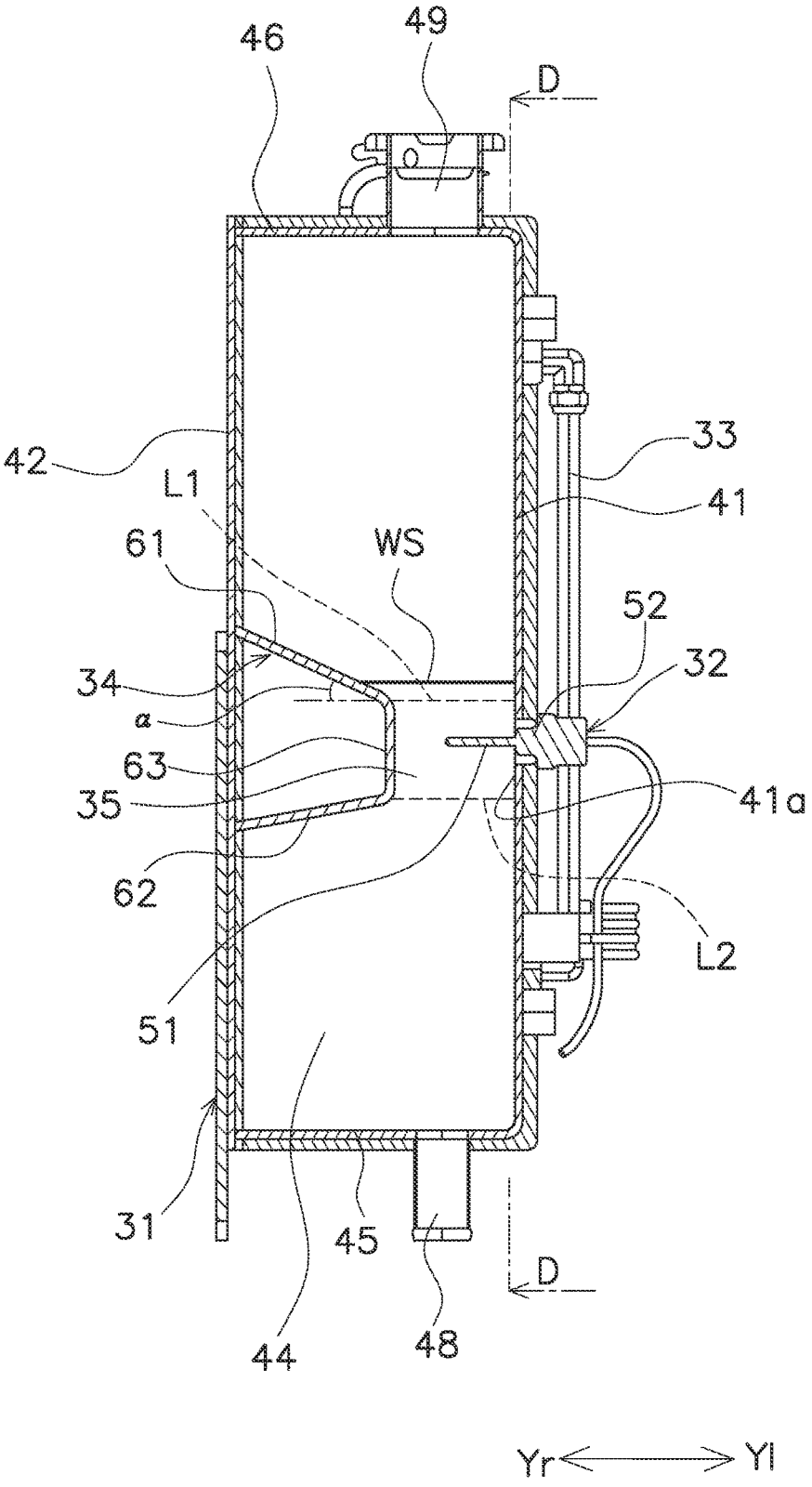
FIG. 4 is a cross-sectional view of FIG. 3 seen from the forward direction.

FIG. 2 is a perspective view of the tank unit 3. FIG. 3 is an arrow cross-sectional view along line A-A' in FIG. 2. FIG. 4 is a cross-sectional view of FIG. 3 as seen from the forward direction Xf side The tank unit 3 stores cooling water for the engine and the radiator. The tank unit 3 includes a tank 31, a water level sensor 32 (example of a sensor), a water level gauge 33, and a hat member 34 (example of a member).

(Tank 31)

The tank 31 has a function for storing the cooling water for the engine and the radiator and a function as an accumulator. As a result, the tank 31 contains a predetermined amount or more of air and stores a predetermined amount or more of the cooling water. While the tank 31 can be formed with a metal material, the material is not limited and the tank 31 may be formed with a resin etc.

While the shape of the tank 31 is not limited in particular, the tank 31 has a substantially rectangular solid shape in the present embodiment. The tank 31 includes, as illustrated in FIG. 2 to FIG. 4, a first side surface 41, a second side surface 42, a third side surface 43, a fourth side surface 44, a bottom surface 45, a top surface 46, an inlet port 47, a discharge port 48, and a water replenishment port 49.

As illustrated in FIG. 3, the first side surface 41 and the second side surface 42 are disposed facing each other in the left-right direction (see arrows Yr and Yl) with a predetermined interval therebetween. The first side surface 41 and the second side surface 42 have roughly the same size and shape, and are formed in rectangular shapes. The first side surface 41 and the second side surface 42 are disposed parallel to each other. The first side surface 41 and the second side surface 42 are disposed in the vertical direction. The first side surface 41 is disposed on the left direction Yl side of the second side surface 42.

As illustrated in FIG. 2, the third side surface 43 joins the end on the forward direction Xf side of the first side surface 41 and the end on the forward direction Xf side of the second side surface 42. As illustrated in FIG. 3, the fourth side surface 44 joins the end on the rearward direction Xb side of the first side surface 41 and the end on the rearward direction Xb side of the second side surface 42. The third side surface 43 and the fourth side surface 44 have roughly the same size and shape, and are formed in rectangular shapes. The third side surface 43 and the fourth side surface 44 are disposed parallel to each other. The third side surface 43 and the fourth side surface 44 are disposed in the vertical direction. The third side surface 43 and the fourth side surface 44 are disposed facing the front-back direction (see arrows Xf and Xb).

The widths in the front-back direction of the first side surface 41 and the second side surface 42 are formed to be greater than the widths in the left-right direction of the third side surface 43 and the fourth side surface 44.

As illustrated in FIGS. 3 and 4, the bottom surface 45 joins the lower end of the first side surface 41, the lower end of the second side surface 42, the lower end of the third side surface 43, and the lower end of the fourth side surface 44. The bottom surface 45 has a rectangular shape. The bottom surface 45 is disposed in the horizontal direction.

As illustrated in FIG. 3, the top surface 46 joins the upper end of the first side surface 41, the upper end of the second side surface 42, the upper end of the third side surface 43, and the upper end of the fourth side surface 44. The top surface 46 has a rectangular shape. The top surface 46 is disposed in the horizontal direction.

The inlet port 47 allows the cooling water for the radiator and the engine to flow into the tank 31. As illustrated in FIG. 2, the inlet port 47 is disposed on the second side surface 42. The inlet port 47 protrudes from an opening formed in the second side surface 42 in the right direction Yr.

The discharge port 48 allows the cooling water to be discharged from the tank 31 toward the radiator and the engine. The discharge port 48 is formed on the bottom surface 45. The discharge port 48 protrudes from an opening formed facing downward in the bottom surface 45.

Water is replenished from the water replenishment port 49 when the water inside the tank 31 is insufficient. The water replenishment port 49 is disposed on the top surface 46. The water replenishment port 49 protrudes upward from an opening formed in the top surface 46 and the protruding tip end has an openable and closeable lid disposed thereto.

(Water Level Sensor 32)

The water level sensor 32 detects the height position of the liquid inside the tank 31. The water level sensor 32 is fixed to the first side surface 41. The water level sensor 32 senses a difference in the relative permittivity in the air and in water and transmits a signal to the control section 4.

As illustrated in FIGS. 3 and 4, the water level sensor 32 includes a detection portion 51 and a support part 52. The detection portion 51 is positioned inside the tank 31 and detects the water level. The detection portion 51 has a rod shape. The support part 52 supports the detection portion 51. The support part 52 is disposed on the first side surface 41. The detection portion 51 protrudes from the support part 52 toward the second side surface 42 perpendicular to the first side surface 41. The detection portion 51 is disposed in the horizontal direction. So long as the detection portion 51 is able to detect the necessary water level, the position in the height direction is not limited in particular. However, in the present embodiment, the detection portion 51 is disposed roughly in the center in the height direction of the tank 31. The support part 52 transmits the detection result of the detection portion 51 to the control section 4. The relative permittivity when the detection portion 51 is exposed from the water changes and the detection signal is transmitted to the control section 4.

As illustrated in FIG. 2, the water level sensor 32 is disposed in the center of the first side surface 41 in the front-back direction (See arrows Xf and Xb).

Even when the vehicle body 2 of the hydraulic excavator 1 of the present embodiment is inclined in the front-back direction, because the water level sensor 32 is disposed in the center of the tank 31 in the front-back direction, the water level changes very little above the water level sensor 32 and a false detection of a shortage in the remaining amount can be suppressed.

In the hydraulic excavator 1 of the present embodiment, the limit inclination angle according to the specifications in the front-back direction is set to 30 degrees.

(Water Level Gauge 33)

The water level gauge 33 enables the water level inside the tank 31 to be confirmed from outside the tank 31. While the type of water level gauge 33 is not limited in particular, for example, a water level gauge may be used that has a configuration so as to be disposed in the vertical direction, be hollow, and such that the water flows therein from the tank 31. The height of the water level of the water level gauge 33 when the vehicle body is horizontal is the same as the height of the water level in the tank 31. As a result, a worker is able to see the height of the water inside the tank 31 by confirming the height of the water level in the water level gauge 33.

While the water level gauge 33 is disposed on the outside of the first side surface 41 in the present embodiment, the water level gauge 33 may be disposed on any side surface.

(Hat Member 34)

Figure 5B:
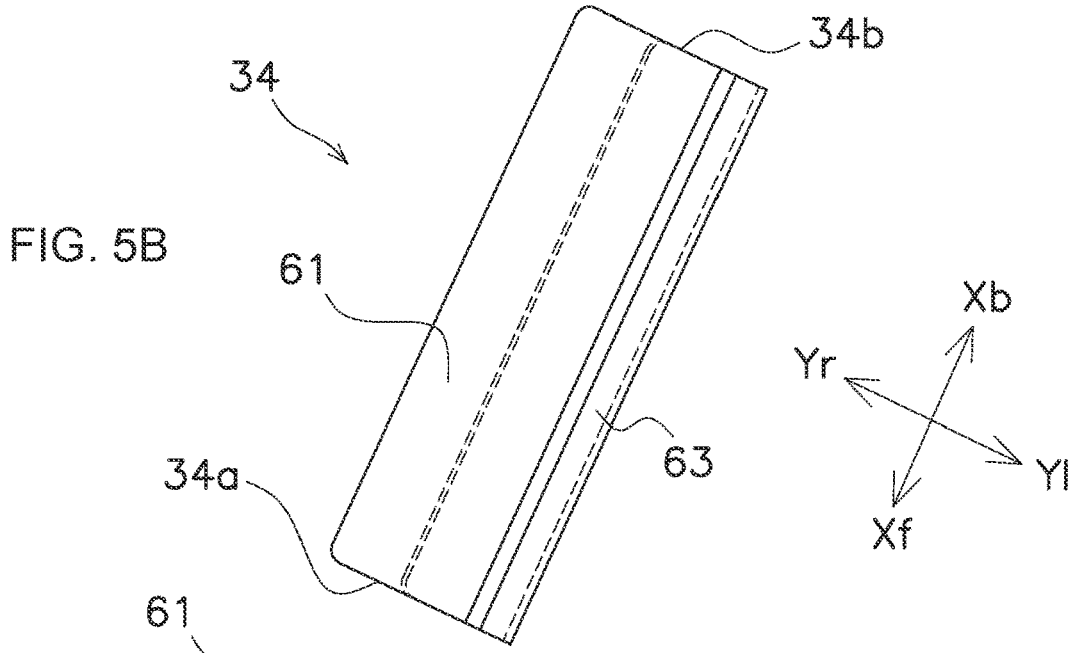
FIG. 5B is a plan view of the hat member along arrow B in FIG. 5A.
Figure 5A:
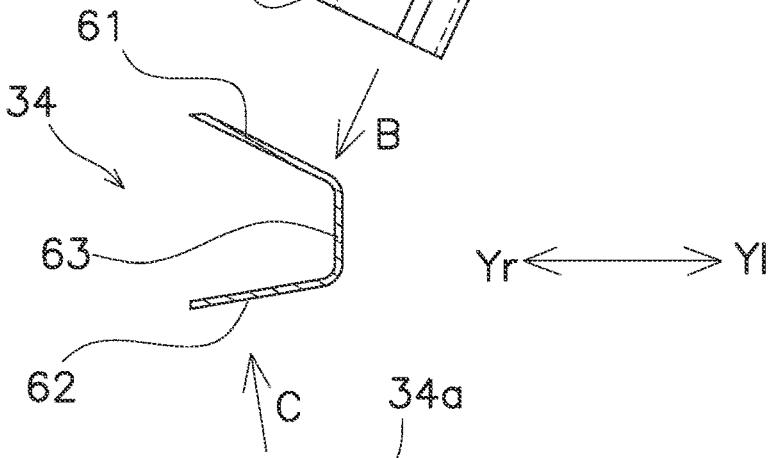
FIG. 5A is a side view of a hat member of the embodiment of the present disclosure.
Figure 5C:
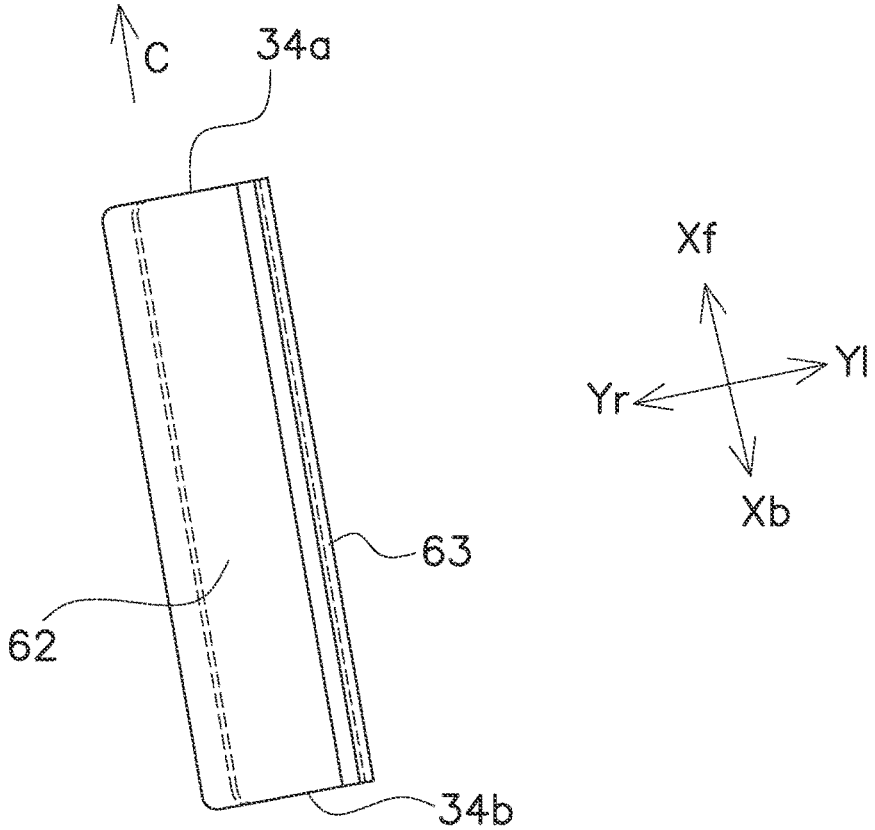
FIG. 5C is a plan view of the hat member along arrow C in FIG. 5A.
Figure 6:
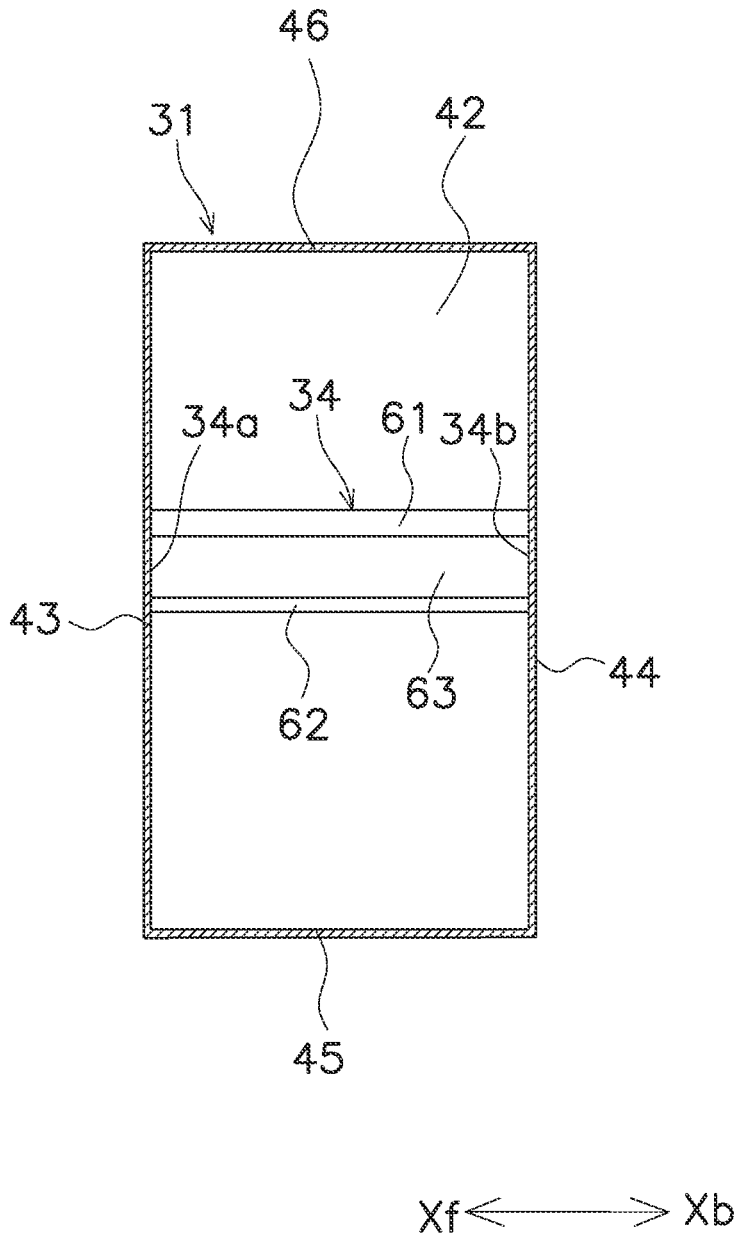
FIG. 6 is a front view of a cross-section along line D-D' in FIG. 4.

FIG. 5A is a side view of the hat member 34. FIG. 5B is a plan view looking at the hat member 34 along arrow B in FIG. 5A. FIG. 5C is a plan view looking at the hat member 34 along arrow C in FIG. 5A. Arrow B is in the direction perpendicular to a below mentioned first portion 61 and arrow C is in the direction perpendicular to a below mentioned third portion 63. FIG. 6 is a schematic cross-sectional view along line D-D' in FIG. 4. The inlet port 47, the discharge port 48, and the water replenishment port 49 are omitted in FIG. 6.

The hat member 34 is a member for reducing the width of a predetermined portion of the tank 31. The hat member 34 forms a reduced-width section 35 in which the width of the tank 31 is reduced. The reduced-width section 35 reduces the width of the tank 31 in the left-right direction (see arrows Yr and Yl). The abovementioned detection portion 51 is disposed in the reduced-width section 35. The width of a predetermined range (between a below mentioned upper end L1 and a lower end L2) including the detection portion 51 in the height direction is reduced in the reduced-width section 35.

While the hat member 34 can be formed with a metal material, the material is not limited to metal and the hat member 34 may be formed with a resin, etc. The material of the hat member 34 is preferably the same as the material of the tank 31 in consideration of attachment to the tank 31. For example, when the tank 31 and the hat member 34 are both formed with a metal material, the hat member 34 can be joined to the tank 31 by welding, etc.

As illustrated in FIG. 4, the hat member 34 is joined and attached to the second side surface 42. As illustrated in FIG. 6, an end 34*a* of the hat member 34 on the forward direction Xf side in the front-back direction (see arrows Xf and Xb) is joined to the third side surface 43, and an end 34*b* on the rearward direction Xb side is joined to the fourth side surface 44. The hat member 34 is formed from one end to the other end of the second side surface 42 in the front-back direction (Yr, Yl).

As illustrated in FIG. 4 and FIG. 5A to FIG. 5C, the hat member 34 includes the first portion 61, a second portion 62, and the third portion 63. The first portion 61, the second portion 62, and the third portion 63 are formed in a planar manner. While the hat member 34 is formed by bending one rectangular plate, the first portion 61, the third portion 63, and the second portion 62 may also be connected by welding, etc.

As illustrated in FIG. 4, the first portion 61 is disposed so as to protrude from the second side surface 42 toward the first side surface 41. The first portion 61 is slanted downward while extending from the second side surface 42 toward the first side surface 41. The end on the right direction Yr side of the first portion 61 is joined to the second side surface 42. As illustrated in FIG. 6, the end on the forward direction Xf side of the first portion 61 is joined to the third side surface 43, and the end on the rearward direction Xb side of the first portion 61 is joined to the fourth side surface 44.

As illustrated in FIG. 4, the second portion 62 is disposed below the first portion 61. The second portion 62 is disposed so as to protrude from the second side surface 42 toward the first side surface 41. The second portion 62 is slanted upward while extending from the second side surface 42 toward the first side surface 41. The end on the right direction Yr side of the second portion 62 is joined to the second side surface 42. As illustrated in FIG. 6, the end on the forward direction Xf side of the second portion 62 is joined to the third side surface 43, and the end on the rearward direction Xb side of the second portion 62 is joined to the fourth side surface 44.

As illustrated in FIG. 4 and FIG. 5A to FIG. 5C, the third portion 63 connects the end on the first side surface 41 side of the first portion 61 and the end on the first side surface 41 side of the second portion 62. The third portion 63 disposed in the vertical direction. As illustrated in FIG. 6, the end on the forward direction Xf side of the third portion 63 is joined to the third side surface 43, and the end on the rearward direction Xb side of the third portion 63 is joined to the fourth side surface 44.

As illustrated in FIG. 4, the third portion 63 is disposed facing the water level sensor 32. The detection portion 51 is disposed between the third portion 63 and a portion 41*a* of the first side surface 41 facing the third portion 63. The reduced-width section 35 is formed by the space between the third portion 63 and the portion 41*a* of the first side surface 41 facing the third portion 63. The upper end of the range of the reduced-width section 35 is depicted with the dotted line L1 and the lower end thereof is depicted with the dotted line L2 in FIG. 4.

The effect of suppressing dead air space can be achieved by means of the abovementioned slopes of the first portion 61 and the second portion 62.

The following is an explanation when the hydraulic excavator 1 is inclined.

In FIG. 4, the water level is indicated by the water surface WS at a LOW level. The water surface WS is located near the lower end of the first portion 61. The LOW level is the lower limit of the water amount for which water replenishment is not necessary. When the water level drops below the LOW level, the detection is not assessed as a false detection even if the water is detected as insufficient.

Figure 7:
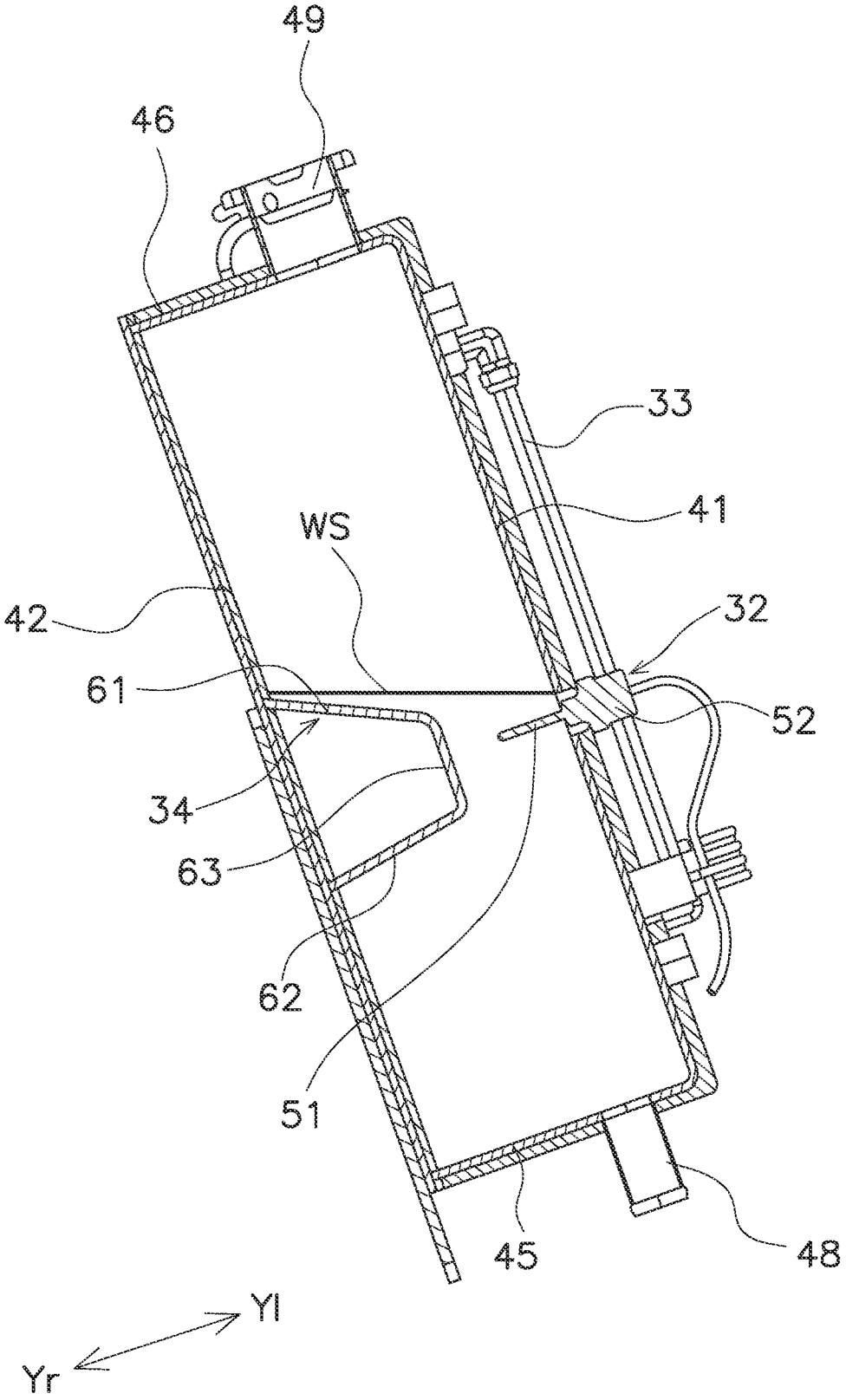
FIG. 7 is a cross-sectional view illustrating a state of the tank while the hydraulic excavator is inclined according to the embodiment of the present disclosure.

FIG. 7 illustrates a state in which the hydraulic excavator 1 is inclined from the state in FIG. 4 up to the limit inclination angle in the specification such that the left side slopes down toward the right side. The water amount inside the tank 31 in the inclined state illustrated in FIG. 7 is the same as the water amount inside the tank 31 in the horizontal state illustrated in FIG. 4.

As illustrated in FIG. 7, the detection portion 51 is positioned below the water surface WS of the LOW level because the width of the portion of the tank 31 where the detection portion 51 is disposed is reduced even when the hydraulic excavator 1 is inclined up to the limit inclination angle in the specification. As a result, even if the tank 31 is inclined, the detection portion 51 is unlikely to be exposed from the water and false detections can be limited. The detection portion 51 is disposed so as not to become exposed from the water surface WS in the state in which the water amount is the LOW level even if the hydraulic excavator 1 is inclined up to the limit inclination angle in the specification.

Because the limit angle in the specification is set to 20 degrees in the left-right direction in the hydraulic excavator 1 of the present embodiment, the inclination angle α of the first portion 61 is preferably set to be greater than 20 degrees for reducing the width of the tank 31.

(Control Section 4)

Figure 8:
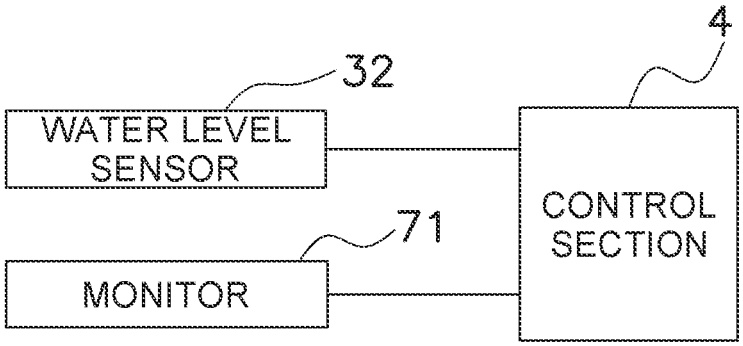
FIG. 8 is a block diagram of a control configuration of the hydraulic excavator of the embodiment of the present disclosure.

FIG. 8 illustrates a control configuration of the hydraulic excavator 1 of the present embodiment. The control section 4 includes a processor and a storage device. The processor is, for example, a central processing unit (CPU). Alternatively, the processor may be a processor different from a CPU. The processor receives the input of the detection value of the water level sensor 32 and executes a process for controlling the monitor 71 in accordance with a program. The storage device includes a non-volatile memory such as a read-only memory (ROM) and/or a volatile memory such as a random access memory (RAM). The storage device may also include an auxiliary storage device such as a hard disk or a solid state drive (SSD). The storage device is an example of a non-transitory computer-readable recording medium. The storage device stores programs and data for controlling the monitor 71.

The control section 4 receives a detection signal from the water level sensor 32 that has detected exposure from the water surface WS, and notifies the worker by causing the monitor 71 to report that the water amount is insufficient.

The worker receives the report from the monitor 71 and replenishes the tank 31 with water through the water replenishment port 49.

(Characteristics)

(1)

The hydraulic excavator 1 of the present embodiment comprises the vehicle body 2, the tank 31, and the water level sensor 32. The tank 31 is disposed in the vehicle body 2 and contains water. The water level sensor 32 includes a detection portion 51 that detects the liquid and is supported to the tank 31. The tank 31 includes the reduced-width section 35. The reduced-width section 35 is formed to reduce the width of a predetermined range (range from the upper end L1 to the lower end L2 illustrated in FIG. 4) including the detection portion 51.

In this way, changes in the position of the liquid surface when the vehicle body 2 is inclined can be reduced by reducing the width of the tank 31 at the portion where the detection portion 51 of the water level sensor 32 is installed for detecting the liquid. As a result, the water level sensor 32 is unlikely to become exposed from the liquid level when the vehicle body 2 is inclined and false detections can be limited.

(2)

The water level sensor 32 in the hydraulic excavator 1 of the present embodiment is supported on the first side surface 41 of the tank 31. The detection portion 51 protrudes from the first side surface 41 toward the second side surface 42 facing the first side surface 41. The reduced-width section 35 is formed between the first side surface 41 and the second side surface 42.

As a result, the width between and the second side surface 42 and the first side surface 41 that supports the water level sensor 32 is partially reduced.

(3)

The hydraulic excavator 1 of the present embodiment further comprises the hat member 34. The hat member 34 forms the reduced-width section 35.

As a result, by disposing the hat member 34 in the tank 31, the reduced-width section 35 can be formed in the tank 31 and false detections of the water level sensor 32 due to inclination can be limited.

(4)

The hat member 34 in the hydraulic excavator 1 of the present embodiment is disposed on the second side surface 42 facing the first side surface 41 and forms the reduced-width section 35. The hat member 34 includes the first portion 61, the second portion 62, and the third portion 63. The first portion 61 is disposed so as to protrude from the second side surface 42 toward the first side surface 41. The second portion 62 is disposed below the first portion 61 and is disposed so as to protrude from the second side surface 42 toward the first side surface 41. The third portion 63 joins the end on the first side surface 41 side of the first portion 61 and the end on the first side surface 41 side of the second portion 62, and faces the detection portion 51.

As a result, the reduced-width section 35 can be formed in the tank 31 because the interval between the third portion 63 and the first side surface 41 is reduced, and false detections by the water level sensor 32 can be limited.

(5)

The first portion 61 in the hydraulic excavator 1 of the present embodiment is inclined so as to face downward and extend toward the first side surface 41.

As a result, pooling of air bubbles on the upper surface of the first portion 61 can be limited. In particular, when the tank 31 is an expansion tank, favorable air-liquid separation can be achieved because air bubbles mixing with the liquid and being discharged can be limited.

(6)

The second portion 62 in the hydraulic excavator 1 of the present embodiment is inclined so as to face upward and extend toward the first side surface 41.

As a result, pooling of air bubbles on the lower surface of the second portion 62 can be limited. In particular, when the tank 31 is an expansion tank, favorable air-liquid separation can be achieved because air bubbles mixing with the liquid and being discharged can be limited.

(7)

The reduced-width section 35 in the hydraulic excavator 1 of the present embodiment is formed to reduce the width of the tank 31 in the left-right direction of the vehicle body 2.

Consequently, changes in the water level due to inclination of the vehicle body 2 in the left-right direction can be limited.

(8)

The water level sensor 32 in the hydraulic excavator 1 of the present embodiment is disposed in the center of the first side surface 41 in the horizontal direction.

Consequently, even when the vehicle body 2 is inclined in the front-back direction that is perpendicular to the direction that the first side surface 41 and the second side surface 42 face, there is very little change in the position of the water surface above the water level sensor 32 because the detection portion 51 of the water level sensor 32 is disposed in the center in the front-back direction. As a result, even if the hydraulic excavator 1 is inclined, the detection of a liquid shortage can be carried out properly.

In addition, when the construction machine is the hydraulic excavator 1, the limit inclination angle of the specification in the front-back direction is set to be greater than the limit inclination angle of the specification in the left-right direction. As a result, false detections can be limited to an even greater extent by disposing the water level sensor 32 in the center in the front-back direction where there is a possibility that the inclination angle is larger and reducing the width inside the tank 31 in the left-right direction.

(9)

The vehicle body 2 in the hydraulic excavator 1 of the present embodiment includes the cab 14, the monitor 71, and the control section 4. The monitor 71 is disposed in the cab 14. The control section 4 issues an alert using the monitor 71 when detecting that the water level sensor 32 is exposed from the liquid level based on a detection value of the water level sensor 32.

As a result, a shortage of the liquid inside the tank 31 can be reported to the operator.

Other Embodiments

Although an embodiment of the present invention has been described so far, the present invention is not limited to the above embodiment and various modifications may be made within the scope of the invention.

(A)

While the hat member 34 is disposed on the second side surface 42 on the right direction Yr side of the tank 31 in the above embodiment, the present invention is not limited in this way and the hat member 34 may be disposed on the first side surface 41.

(B)

While the hat member 34 is disposed on the second side surface 42 so that a portion of the width of the tank 31 in the left-right direction is reduced, the present invention is not limited in this way and the hat member 34 may be disposed on the third side surface 43 or the fourth side surface 44 so as to reduce a portion of the width of the tank 31 in the front-back direction. In this case, the water level sensor 32 is preferably disposed in the center in the left-right direction on the side surface where the hat member 34 is not provided among the third side surface 43 and the fourth side surface 44.

While the limit inclination angle of the specification in the front-back direction is formed to be greater than the limit inclination angle of the specification in the left-right direction in the above embodiment, the opposite is also possible according to the vehicle type or class.

That is, when the limit inclination angles of the specification are different in the front-back direction and the left-right direction, false detections due to changes in the water level are preferably limited with respect to the inclination in which the limit inclination angle is larger when the water level sensor 32 is disposed in the center on the side surface in said direction, and false detections due to changes in the water level are preferably suppressed with respect to the inclination in which the limit inclination angle is smaller when the hat member is disposed and the width is reduced.

In other words, the hat member 34 may be disposed in the tank 31 on the basis of the limit angles in the front-back direction and the left-right direction determined according to the vehicle type and class.

(C)

While false detections due to the inclination of the vehicle body 2 in the front-back direction are suppressed by disposing the water level sensor 32 in the center of the first side surface 41 in the front-back direction in the above embodiment, the present invention is not limited in this way. For example, the width of the tank 31 may be reduced in the front-back direction near where the water level sensor 32 is disposed by further providing another hat member.

Figure 9C:
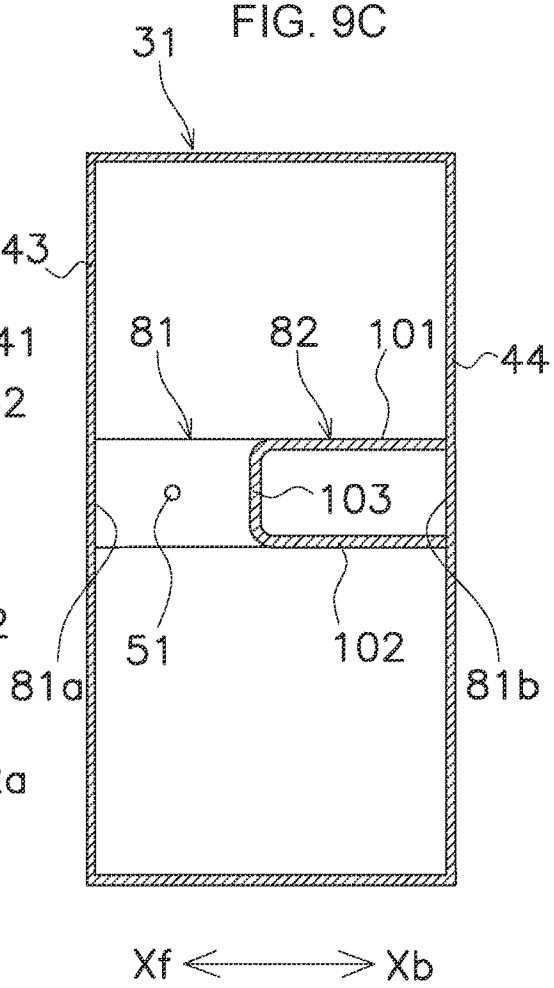
FIG. 9C is a cross-sectional view along line F-F' in FIG. 9A.
Figure 9B:
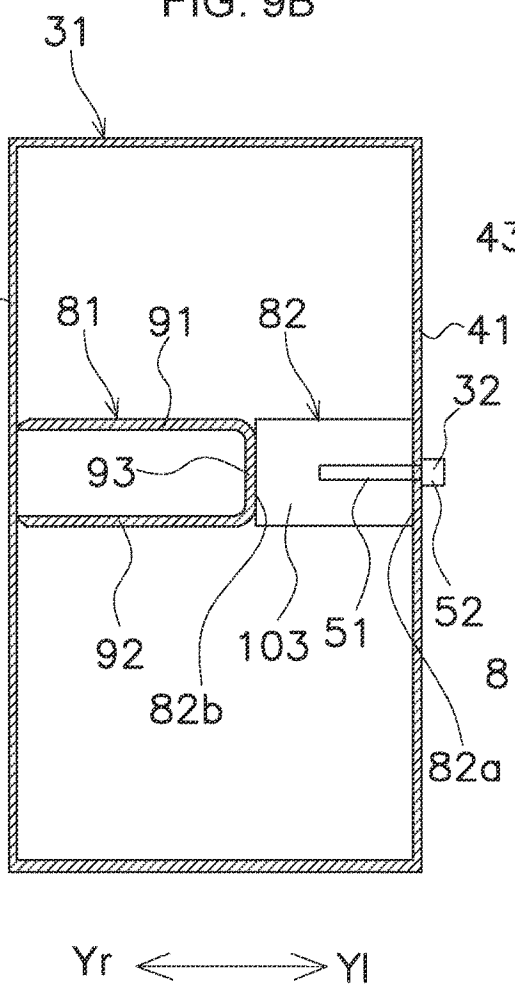
FIG. 9B is a cross-sectional view along line E-E' in FIG. 9A.
Figure 9A:
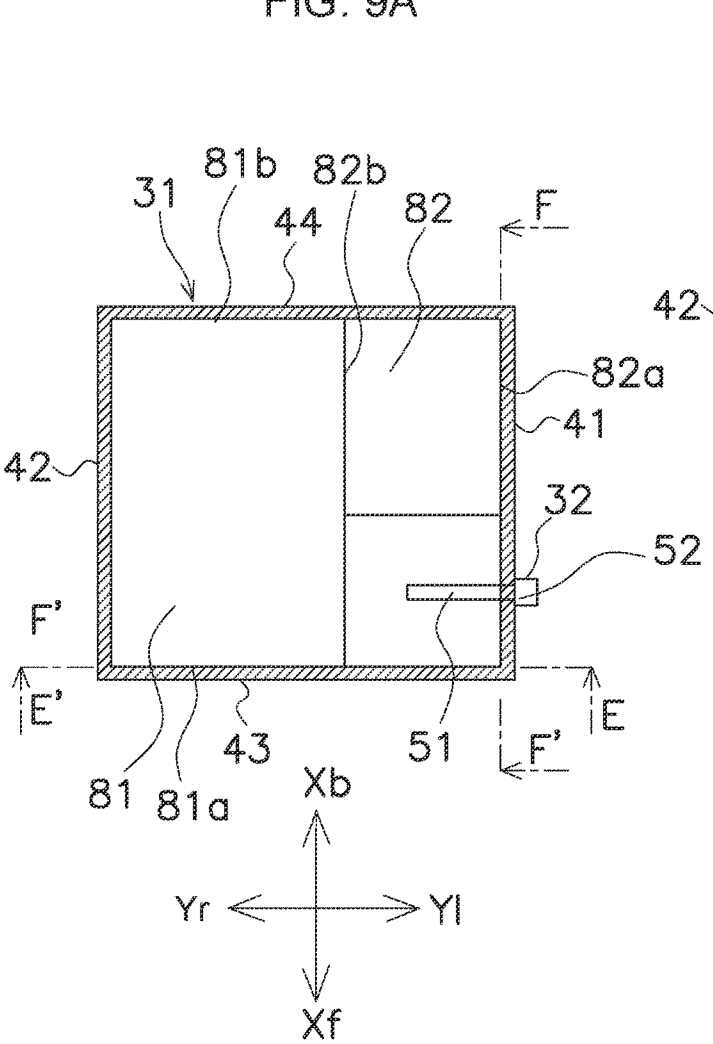
FIG. 9A is a plan cross-sectional view of the tank for explaining the hat member of a modified example of the embodiment of the present disclosure.

FIG. 9A is a plan cross-sectional view of a state in which two hat members, a first hat member 81 and a second hat member 82, are disposed in the tank 31. FIG. 9B is an arrow cross-sectional view along line E-E' in FIG. 9A. FIG. 9C is an arrow cross-sectional view along line F-F' in FIG. 9A.

The first hat member 81 includes a first portion 91, a second portion 92, and a third portion 93 as illustrated in FIG. 9B. The first portion 91 is disposed so as to protrude from the second side surface 42 toward the first side surface 41. The second portion 92 is disposed below the first portion 91 and is disposed so as to protrude from the second side surface 42 toward the first side surface 41. The third portion 93 joins the end on the first side surface 41 side of the first portion 91 and the end on the first side surface 41 side of the second portion 92, and faces the detection portion 51. The first portion 91 and the second portion 92 are disposed in the horizontal direction. The third portion 93 is disposed in the vertical direction. As illustrated in FIG. 9A, an end 81*a* on the forward direction Xf side of the first hat member 81 is joined to the third side surface 43, and an end 81*a* on the rearward direction Xb side of the first hat member 81 is joined to the fourth side surface 44.

The second hat member 82 includes a first portion 101, a second portion 102, and a third portion 103 as illustrated in FIG. 9C. The first portion 101 protrudes from the fourth side surface 44 toward the third side surface 43. The second portion 102 is disposed below the first portion 101 and is disposed so as to protrude from the fourth side surface 44 toward the third side surface 43. The third portion 103 joins the end on the third side surface 43 side of the first portion 101 and the end on the third side surface 43 side of the second portion 102, and faces the detection portion 51. The first portion 101 and the second portion 102 are disposed in the horizontal direction. The third portion 103 is disposed in the vertical direction. As illustrated in FIG. 9B, the end 82*a* on the left direction Yl side of the second hat member 82 is joined to the first side surface 41, and the end 82*b* on the right direction Yr side of the second hat member 82 is joined to the third portion 93 of the first hat member 81.

As a result, false detections can be suppressed even when the vehicle body 2 is inclined in the left-right direction or the front-back direction because the widths in both the front-back direction and the left-right direction of the portion of the tank 31 where the detection portion 51 of the water level sensor 32 is disposed, are reduced.

(D)

While the use of an expansion tank for storing water is described as an example of the tank in the above embodiment, the present invention is not limited to an expansion tank. For example, the hat member 34 described in the above embodiment may also be applied to a fuel tank or a hydraulic fluid tank that stores a liquid oil such as fuel or hydraulic fluid.

(E)

While the hat member 34 as an example of the member that forms the reduced-width section 35 is formed by the three flat plates made up of the first portion 61, the second portion 62, and the third portion 63 in the above embodiment, the present invention is not limited in this way. That is, there is no specific limitation and curved members may be used so long as the members are able to form the reduced-width section 35. In addition, the reduced-width section may be formed in a portion of the tank by integral molding.

(F)

While a hydraulic excavator was discussed as an example of the construction machine in the above embodiment, the present invention is not limited in this way and the construction machine may be a bulldozer or a wheel loader, etc.

(G)

While the notification is displayed on the monitor 71 for issuing an alert to the worker of the water shortage in the above embodiment, the present invention is not limited to the monitor 71 and the alert may be issued by a lamp or by sound.

The configuration of the present disclosure exhibits the effect of being able to limit false detections of a shortage of liquid and is useful in a construction machine such as a hydraulic excavator.

What is claimed is:

1. A construction machine comprising:

a vehicle body;

a tank disposed in the vehicle body, the tank accommodating a liquid, the tank having a first side surface and a second side surface facing the first side surface inside the tank;

a sensor including a detection portion configured to detect the liquid, the sensor being supported on the first side surface of the tank and the detection portion protruding from the first side surface toward the second side surface inside the tank; and a member disposed on the second side surface and protruding toward the first side surface inside the tank, the tank including a reduced width section formed to reduce a width of a predetermined range including the detection portion, the reduced width section being formed by the member between the first side surface and the second side surface.

2. The construction machine according to claim 1, wherein the reduced width section is formed so that the width of the tank is reduced in a left to right direction of the vehicle body.

3. The construction machine according to claim 2, wherein the vehicle body includes a cab, a monitor disposed in the cab, and a control section configured to issue an alert using the monitor when detecting that the sensor has detected exposure from a liquid surface based on a detection value of the sensor.

4. The construction machine according to claim 1, wherein the sensor is disposed in a center of the first side surface in a horizontal direction.

5. The construction machine according to claim 4, wherein the vehicle body includes a cab, a monitor disposed in the cab, and a control section configured to issue an alert using the monitor when detecting that the sensor has detected exposure from a liquid surface based on a detection value of the sensor.

6. The construction machine according to claim 1, wherein the vehicle body includes a cab, a monitor disposed in the cab, and a control section configured to issue an alert using the monitor when detecting that the sensor has detected exposure from a liquid surface based on a detection value of the sensor.

7. A construction machine comprising:

a vehicle body;

a tank disposed in the vehicle body, the tank accommodating a liquid;

a sensor including a detection portion configured to detect the liquid, the sensor being supported on a first side surface of the tank and the detection portion protruding from the first side surface toward a second side surface of the tank, the second side surface facing the first side surface; and a member disposed on the second side surface, the tank including a reduced width section formed to reduce a width of a predetermined range including the detection portion, the reduced width section being formed by the member between the first side surface and the second side surface, the member including a first portion protruding from the second side surface toward the first side surface, a second portion disposed below the first portion, the second portion protruding from the second side surface toward the first side surface, and a third portion joining an end on a side of the first side surface of the first portion and an end on a side of the first side surface of the second portion, the third portion facing the detection portion.

8. The construction machine according to claim 7, wherein the first portion is slanted downward and extends toward the first side surface.

9. The construction machine according to claim 8, wherein the second portion is slanted upward and extends toward the first side surface.

10. The construction machine according to claim 8, wherein the reduced width section is formed so that the width of the tank is reduced in a left to right direction of the vehicle body.

11. The construction machine according to claim 8, wherein the vehicle body includes a cab, a monitor disposed in the cab, and a control section configured to issue an alert using the monitor when detecting that the sensor has detected exposure from a liquid surface based on a detection value of the sensor.

12. The construction machine according to claim 7, wherein the second portion is slanted upward and extends toward the first side surface.

13. The construction machine according to claim 12, wherein the reduced width section is formed so that the width of the tank is reduced in a left to right direction of the vehicle body.

14. The construction machine according to claim 12, wherein the vehicle body includes a cab, a monitor disposed in the cab, and a control section configured to issue an alert using the monitor when detecting that the sensor has detected exposure from a liquid surface based on a detection value of the sensor.

15. The construction machine according to claim 7, wherein the reduced width section is formed so that the width of the tank is reduced in a left to right direction of the vehicle body.

16. The construction machine according to claim 7, wherein the vehicle body includes a cab, a monitor disposed in the cab, and a control section configured to issue an alert using the monitor when detecting that the sensor has detected exposure from a liquid surface based on a detection value of the sensor.

* * * * *